US007885553B2

(12) United States Patent
Otawa et al.

(10) Patent No.: US 7,885,553 B2
(45) Date of Patent: Feb. 8, 2011

(54) IMAGE FORMING APPARATUS AND METHOD FOR CONTROLLING ACCESS TO REPLACEABLE UNITS

(75) Inventors: Yasuhiko Otawa, Saitama (JP); Miho Sasaki, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1081 days.

(21) Appl. No.: 11/492,796

(22) Filed: Jul. 26, 2006

(65) Prior Publication Data

US 2007/0086793 A1 Apr. 19, 2007

(30) Foreign Application Priority Data

Oct. 19, 2005 (JP) ..... 2005-304074

(51) Int. Cl.
*G03G 15/00* (2006.01)

(52) U.S. Cl. ..... 399/12; 399/13; 399/27

(58) Field of Classification Search ..... 399/12, 399/13, 27

See application file for complete search history.

(56) References Cited

U.S. PATENT DOCUMENTS 5,907,748 A * 5/1999 Kawana ..... 399/111
6,647,214 B2 * 11/2003 Takahashi ..... 399/13
2005/0084272 A1 * 4/2005 Kikuchi ..... 399/12
2005/0095017 A1 * 5/2005 Kikuchi ..... 399/12

FOREIGN PATENT DOCUMENTS

JP 2002-169429 A 6/2002
JP 2004-114652 A 4/2004
JP 2004294911 A * 10/2004
JP 2005-189280 A 7/2005

* cited by examiner

*Primary Examiner*—Ryan D Walsh
(74) *Attorney, Agent, or Firm*—Sughrue Mion, PLLC

(57) ABSTRACT

An image forming apparatus that includes: an image forming apparatus main body; a replaceable unit which is attached to the image forming apparatus main body in a detachable manner; a storage unit provided in the replaceable unit, the storage unit storing information with respect to the replaceable unit; a first detecting unit that detects a first-stage operation for replacing the replaceable unit and other operation at a first stage of replacing the replaceable unit; a second detecting unit that detects a second-stage operation for replacing the replaceable unit at a second stage of replacing the replaceable unit; and a control unit that controls access to the storage unit in accordance with whether the second detecting unit detects the second-stage operation, when the first detecting unit detects the first-stage operation.

5 Claims, 13 Drawing Sheets

REPLACEMENT OPERATION DETECTION PROCESS (S10)

REPLACEMENT OPERATION DETECTION PROCESS (S10)

FIG. 5A

TONER CARTRIDGE 34:

| Y | M | C | B |
|---|---|---|---|
| 0 | 0 | 0 | 0 |

FIG. 5B

TONER CARTRIDGE 34:

| Y | M | C | B |
|---|---|---|---|
| 1 | 0 | 1 | 0 |

RECOVERY PROCESS (S12)

ACCESS CONTROL PROCESS (S14)

TONER CARTRIDGE 34:

| Y | M | C | B |
|---|---|---|---|
| 1 | 0 | 1 | 0 |

TONER CARTRIDGE 34:

| Y | M | C | B |
|---|---|---|---|
| 0 | 0 | 1 | 0 |

ACCESS CONTROL PROCESS (S16)

IMAGE FORMING APPARATUS AND METHOD FOR CONTROLLING ACCESS TO REPLACEABLE UNITS

BACKGROUND

1. Technical Field

The present invention relates to an image forming apparatus such as a printer, a copier, or a facsimile machine as well as to its control method.

2. Related Art

Among image forming apparatus of the above kind are ones that are provided with plural replaceable units. For example, image forming apparatus are known in which the replaceable units are equipped with storage means for storing data relating to the replaceable units, respectively, and which has a control means for accessing the storage means (See, e.g. JP-A-2002-169429, JP-A-2004-114652 and JP-A-2005-189280).

However, in the conventional techniques, when an opening/closing cover which is provided to enable attachment/detachment of the replaceable units is closed, the storage means of unreplaced replaceable units are also accessed. Recovery processing takes long time.

The present invention provides an image forming apparatus and its control method, which can shorten the recovery processing time.

SUMMARY OF THE INVENTION

According to an aspect of the present invention, an image forming apparatus includes: an image forming apparatus main body; a replaceable unit which is attached to the image forming apparatus main body in a detachable manner; a storage unit provided in the replaceable unit, the storage unit storing information with respect to the replaceable unit; a first detecting unit that detects a first-stage operation for replacing the replaceable unit and other operation at a first stage of replacing the replaceable unit; a second detecting unit that detects a second-stage operation for replacing the replaceable unit at a second stage of replacing the replaceable unit; and a control unit that controls access to the storage unit in accordance with whether the second detecting unit detects the second-stage operation, when the first detecting unit detects the first-stage operation.

According to another aspect of the present invention, an image forming apparatus includes: an image forming apparatus main body; plural replaceable units attached to the image forming apparatus main body in a detachable manner; plural storage units provided in the replaceable units, the storage units storing information with respect to the replaceable units; a first detecting unit that detects a first-stage operation for replacing the replaceable units and other operation at a first stage of replacing the replaceable units; a second detecting unit that detects a second-stage operation for replacing the replaceable units at a second stage of replacing the replaceable units; and a control unit that controls access only to the storage units corresponding to the replaced replaceable units, in accordance with a detection of the second-stage operation by the second detecting unit, when the first detecting unit detects the first-stage operation.

According to yet another aspect of the present invention, a control method of an image forming apparatus includes: detecting a first-stage operation for replacing the replaceable unit and other operation as a first stage, the replaceable unit being attached to an image forming apparatus main body in a detachable manner; detecting a second-stage operation for replacing the replaceable unit as a second stage; and controlling access to the storage unit in accordance with whether the second-stage operation is detected, when the first-stage operation is detected.

BRIEF DESCRIPTION OF THE DRAWINGS

FIGS. 5A and 5B show toner cartridge attachment/detachment history data stored in a RAM of the control section according to the embodiment of the invention; FIG. 5A shows a state before updating by a replacement operation detection process, and FIG. 5B shows a state after the updating by the replacement operation detection process;

FIG. 8A shows a state before updating by an access control process and FIG. 8B shows a state after the updating by the access control process;

DETAILED DESCRIPTION OF THE INVENTION

Embodiments of the present invention will be described with reference to the drawings.

Figure 1:
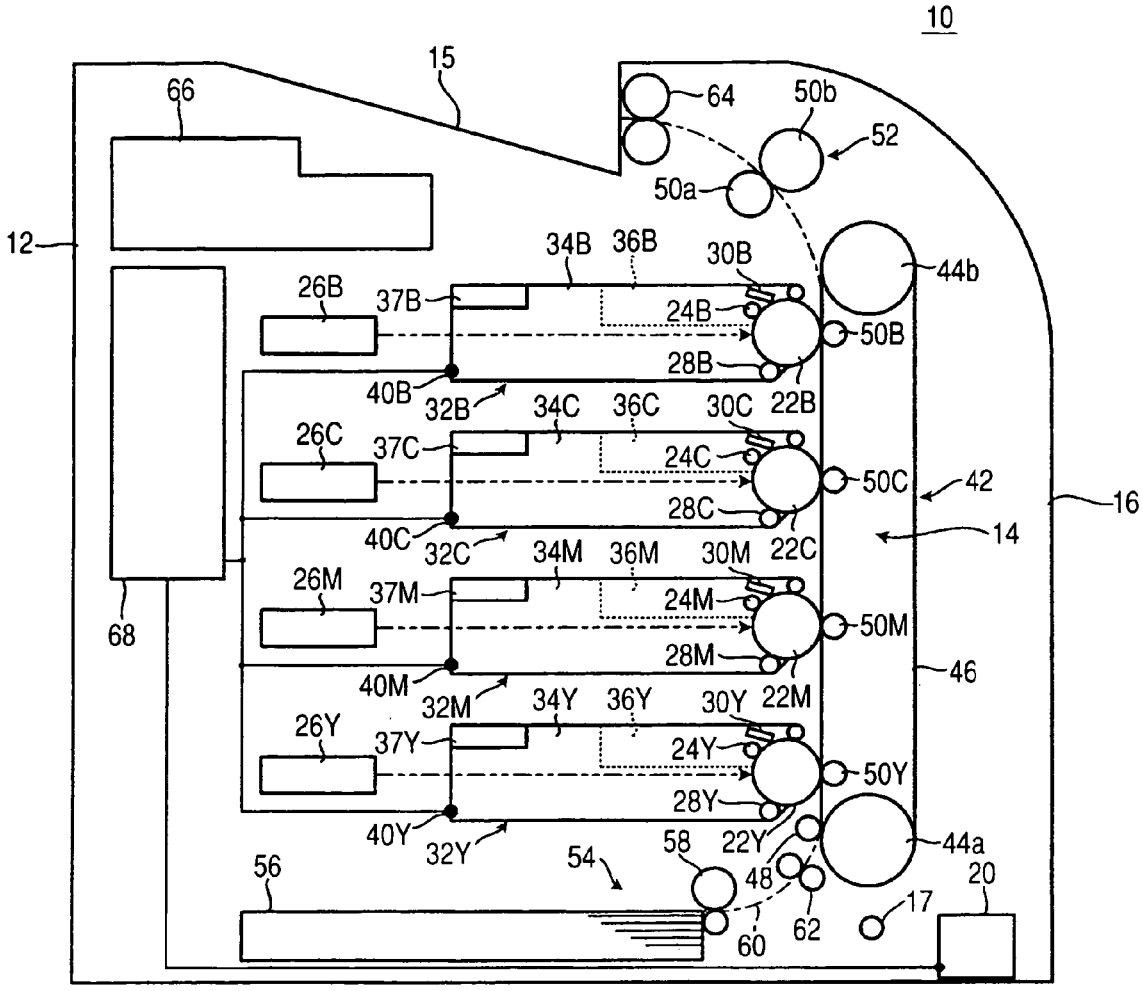
FIG. 1 is a side view of an image forming apparatus according to an embodiment of the present invention.
Figure 2:
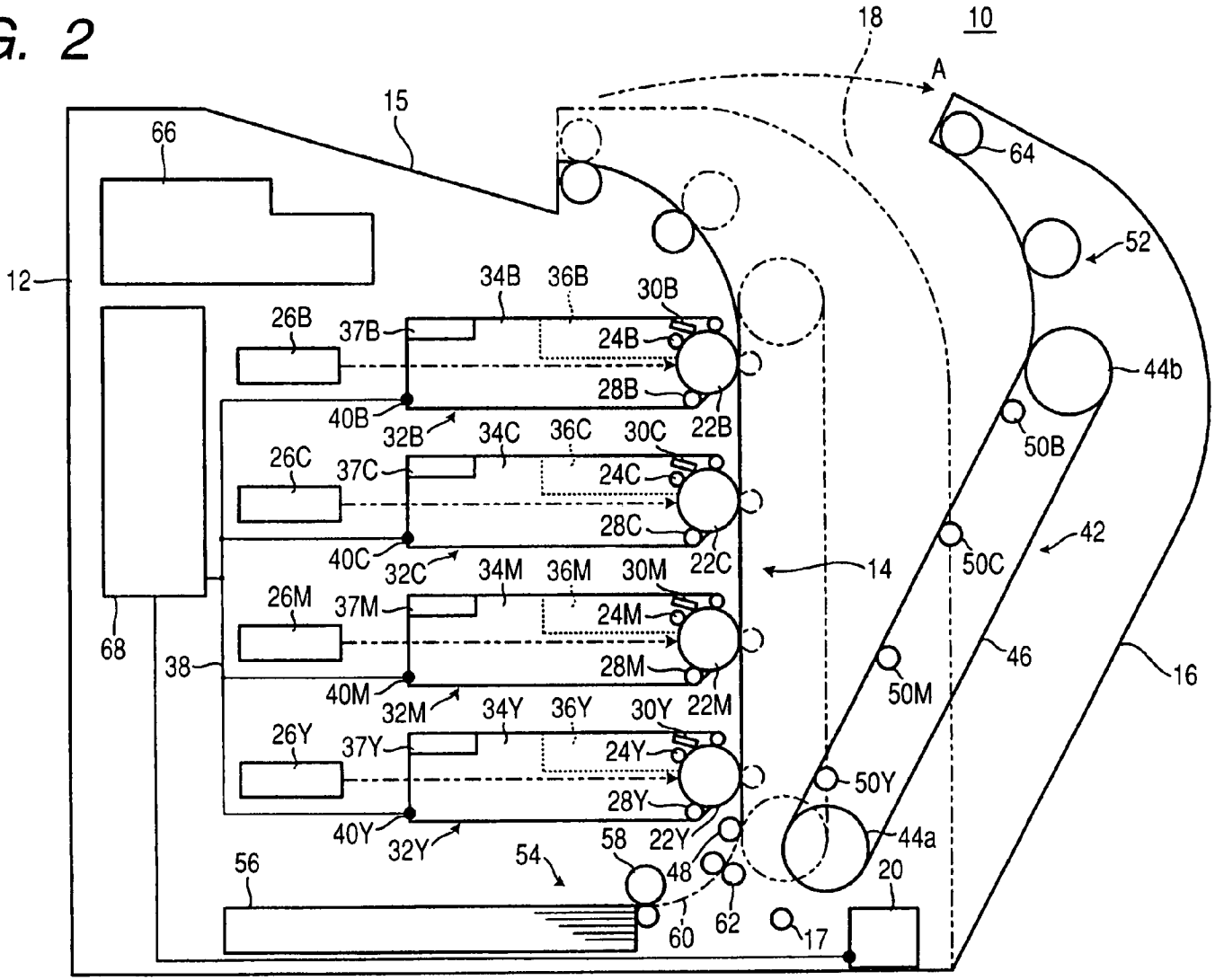
FIG. 2 is a side view of the image forming apparatus according to the embodiment of the invention in a state that an opening/closing cover is open.

FIGS. 1 and 2 show an image forming apparatus 10 according to an embodiment of the invention. The image forming apparatus 10 has an image forming apparatus main body 12. And an image forming means 14, a sheet supply unit 54 as a sheet supply means, a power unit 66, and a control section 68 as a control means are disposed in the image forming apparatus main body 12.

A sheet ejection unit 15 to which image-formed sheets are ejected occupies a top portion of the image forming apparatus main body 12. An opening/closing cover 16 as an opening/closing means is provided as a right side wall of the image forming apparatus main body 12. The opening/closing cover 16 is attached to the image forming apparatus main body 12 so as to be rotatable about a rotation support shaft 17 as a supporting point which is disposed in the vicinity of the bottom end of the right side wall of the image forming apparatus main body 12. As shown in FIG. 2, when the opening/closing cover 16 is opened by rotating it rightward (i.e., in the direction indicated by arrow A in FIG. 2) with respect to the image forming apparatus main body 12, an open space 18 is formed, through which toner cartridges 34Y, 34M, 34C, and 34B, process cartridges 32Y, 32M, 32C, and 32B, etc. as replaceable units (described later) can be attached or detached (i.e., subjected to a replacement operation). As described later, when a jam has occurred in the image forming apparatus main body 12, a jam-resolving operation can likewise be performed by opening the opening/closing cover 16.

An opening/closing detection sensor 20 as a first detecting means for detecting opening or closing of the opening/closing cover 16 by, for example, contacting or being separated from the opening/closing cover 16 as it is opened or closed is disposed in the vicinity of the rotation support shaft 17. As such, the opening/closing detection sensor 20 functions as a sensor (detecting means) for detecting an operation (i.e., an operation of opening or closing the opening/closing cover 16) that is necessary for replaceable unit replacement or any of other operations (e.g., a jam-resolving operation) by detecting opening or closing of the opening/closing cover 16. A detection result of the opening/closing detection sensor 20 (e.g., "on" (detection) when the opening/closing cover 16 is open or "off" when it is closed) is output to the control section 68 (described later).

The image forming means 14, which is of an electrophotographic type and forms a color image, is equipped with drum-shaped photoreceptor bodies 22Y, 22M, 22C, and 22B as image carrying bodies for carrying developer images, charging units 24Y, 24M, 24C, and 24B as charging means having charging rollers for charging the respective photoreceptor bodies 22Y, 22M, 22C, and 22B uniformly, optical writing units 26Y, 26M, 26C, and 26B as latent image forming means for writing electrostatic latent images to the respective photoreceptor bodies 22Y, 22M, 22C, and 22B using light, developing units 28Y, 28M, 28C, and 28B as developing means for developing, with developers (toners), the latent images written to the respective photoreceptor bodies 22Y, 22M, 22C, and 22B, and cleaning units 30Y, 30M, 30C, and 30B as developer removing means for removing developers remaining on the respective photoreceptor bodies 22Y, 22M, 22C, and 22B after developer images have been transferred by a transfer unit 42 (described later).

The optical writing units 26Y, 26M, 26C, and 26B, which are laser exposing units, irradiate the photoreceptor bodies 22Y, 22M, 22C, and 22B with laser beams corresponding to yellow, magenta, cyan, and black images and thereby write electrostatic latent images thereto, respectively.

Each process cartridge 32 as a replaceable unit, which is attached to the image forming apparatus main body 12 in a detachable manner, is an integral unit of the photoreceptor body 22, the charging unit 24, the developing unit 28, and the cleaning unit 30. The toner cartridge (replaceable unit) 34 as a developer container (toner bottle) in which a developer (toner) to be supplied to the developing unit 28 is accommodated and a waste toner bottle 36 as a developer collection container for collecting a developer (toner) removed by the cleaning unit 30 are provided so as to be integrated with or detachable from the process cartridge 32.

In the image forming apparatus main body 12, the process cartridges 32Y, 32M, 32C, and 32B are arranged in this order upward (in FIG. 1) along a transport belt 46 (described later)

The process cartridges 32Y, 32M, 32C, and 32B are for formation of yellow, magenta, cyan, and black images, respectively. Therefore, yellow, magenta, cyan, and black toners are charged (accommodated) in the respective toner cartridges 34Y, 34M, 34C, and 34B.

The toner cartridges 34Y, 34M, 34C, and 34B are provided with memory chips 37Y, 37M, 37C, and 37B as storage means (described later with reference to FIG. 3), respectively. The toner cartridges 34Y, 34M, 34C, and 34B are also provided with presence/absence detection sensors 40Y, 40M, 40C, and 40B (described later with reference to FIG. 3) as second detecting means for detecting presence/absence of the toner cartridges 34Y, 34M, 34C, and 34B, respectively.

The transfer unit 42 as a transfer means is disposed inside the opening/closing cover 16 so as to be in contact with the photoreceptor bodies 22Y, 22M, 22C, and 22B of the process cartridges 32Y, 32M, 32C, and 32B. The transfer unit 42 is an integral unit and is equipped with two support rollers 44*a* and 44*b*, a transport belt 46 as a transport means for transporting a sheet or images, an absorption roller 48 as an absorption means for causing the transport belt 46 to absorb a sheet, and transfer rollers SOY, 50M, 50C, and 50B for transferring developer images formed on the respective photoreceptor bodies 22Y, 22M, 22C, and 22B to a sheet being transported by the transport belt 46. When the opening/closing cover 16 is opened, the transfer unit 42 is rotated together with the opening/closing cover 16 about the rotation support shaft 17 (supporting point) and is thereby separated from the photoreceptor bodies 22Y, 22M, 22C, and 22B. Therefore, when a jam has occurred on the transport belt 46, a jam-resolving operation can be performed by opening the opening/closing cover 16.

The absorption roller 48 is provided so as to be in pressure contact with the support roller 44*a* via the transport belt 46 and is given a voltage by the power unit 66. As such, the absorption roller 48 causes the transport belt 46 to absorb a sheet electrostatically.

Transfer biases are applied to the respective transfer rollers 50Y, 50M, 50C, and 50B. And the transfer rollers 50Y, 50M, 50C, and 50B transfer, in order, developer images formed on the photoreceptor bodies 22Y, 22M, 22C, and 22B to a sheet being transported by the transport belt 46, and thereby form, on the sheet, a color developer image as a superimposed image of the developer images of the four colors (yellow, magenta, cyan, and black).

A fixing unit 52 for fusing, onto a sheet, a developer image that has been transferred to the sheet by the transfer unit 42 is disposed in the image forming apparatus main body 12 at a top position. Composed of a heating roller 52*a* and a pressure roller 52*b*, the fixing unit 52 fuses a developer image onto a sheet passing between the heating roller 52*a* and the pressure roller 52*b* by giving heat and pressure to the sheet.

The sheet supply unit 54 as a sheet supply means occupies a bottom portion of the image forming apparatus main body 12. The sheet supply unit 54 has a sheet supply cassette 56 to be loaded with sheets and a feed roller 58 for sending out a sheet from the sheet supply cassette 56 to registration rollers 62 (described later). The sheet supply cassette 56 is provided so as to be detachable from the image forming apparatus main body 12, and sheets (transfer subjects) such as plain sheets or OHP sheets are accommodated (loaded) therein.

The image forming apparatus main body 12 is provided with a transport path 60 which extends from the sheet supply cassette 56 to ejection rollers 64 (described later). The transport path 60 is a transport path along which a sheet fed from the sheet supply cassette 56 is transported to the sheet ejection unit 15. The registration rollers 62, the transfer unit 42, the fixing unit 52, and the ejection rollers 64 are arranged along the transport path 60 in this order downstream in the sheet transport direction. The registration rollers 62 are disposed so as to supply a sheet to the above-described transfer unit 42 with prescribed timing. The ejection rollers 64 are disposed so as to eject, to the sheet ejection unit 15, a sheet transported from the fixing unit 52.

Although the process cartridges 32 and the toner cartridges 34 have been described as exemplary replaceable units, a replaceable unit may be formed by combining two or more of the photoreceptor bodies 22, the charging units 24, the optical writing units 26, the developing units 28, the cleaning units 30, the waste toner bottles 36, the transfer unit 42, the fixing unit 52, and the sheet supply unit 54 which are attached to the image forming apparatus main body 12 in a detachable manner.

Next, circuit configurations of the control section 68 and each memory chip 37 will be described.

Figure 3:
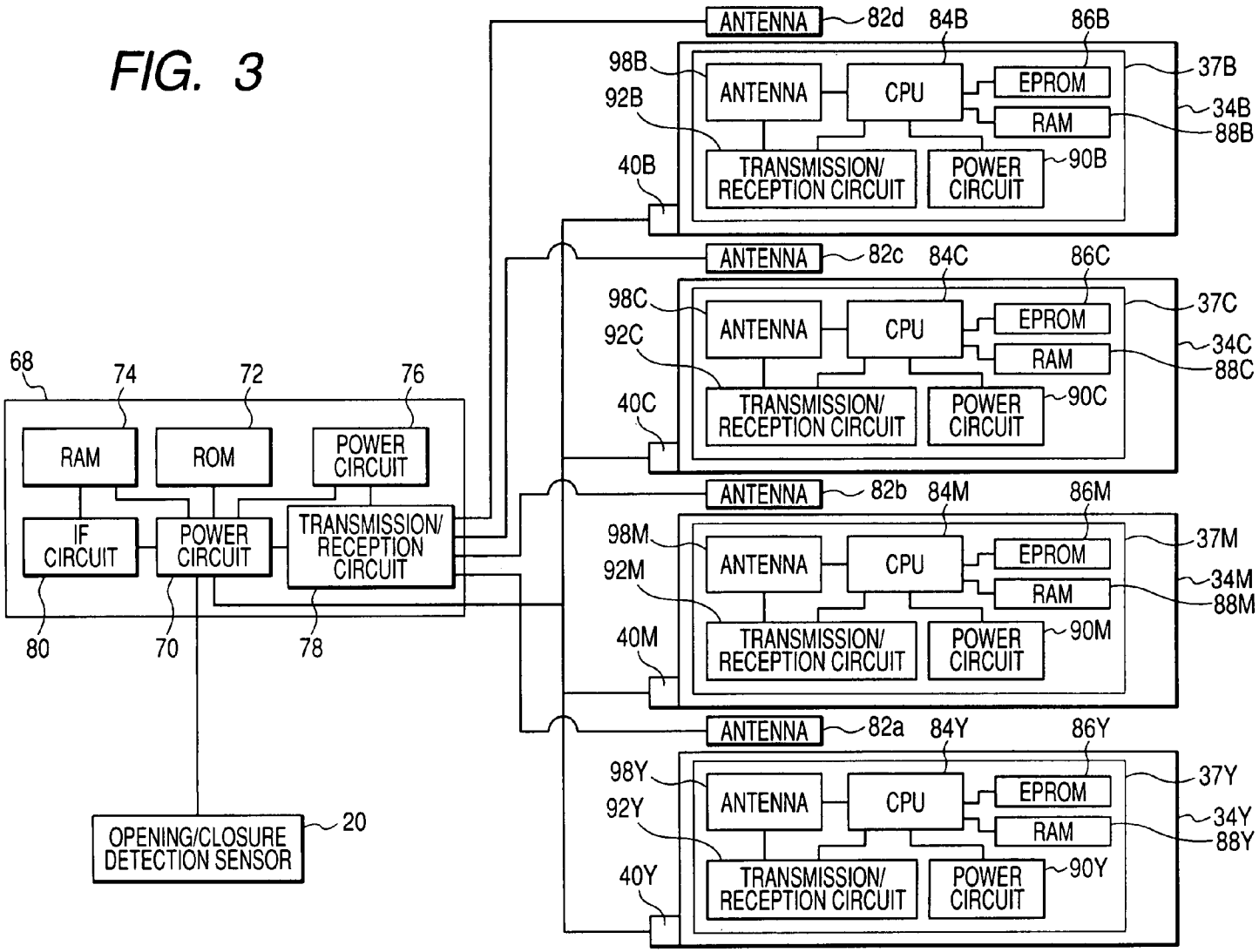
FIG. 3 is a block diagram showing the circuit configurations of a control section and each memory chip according to the embodiment of the invention.

FIG. 3 is a block diagram mainly showing the circuit configurations of the control section 68 and each memory chip 37.

As shown in FIG. 3, the control section 68 includes a CPU 70, a ROM 72, a RAM 74, a power circuit 76, a transmission/reception circuit 78, and an interface (IF) circuit 80.

In the control section 68, the CPU 70 controls the individual components of the control section 68. The ROM 72 is a flash ROM, for example, and stores information that is necessary for control of the image forming apparatus 10. The RAM 74 is an SRAM, for example, and stores temporary information such as image data that are input from the IF circuit 80. The RAM 74 also stores such information as toner cartridge attachment/detachment history data, toner unit attachment/detachment history data, and replaceable unit attachment/detachment history data (all described later). The power circuit 76 supplies power that is necessary for operation of the individual components of the control section 68. The transmission/reception circuit 78 demodulates signals received by antennas 82*a* to 82*d* (described later), reproduce data contained in the reception signals, and outputs the data to the CPU 70. The IF circuit 80 exchanges image data etc. with an external computer via a network or the like.

A detection result of the opening/closing detection sensor 20 and detection results of the presence/absence detection sensors 40Y, 40M, 40C, and 40B are input to the CPU 70.

The antennas 82*a* to 82*d* receive pieces of information relating to the toner cartridges 34 that are sent from the memory chips 37 of the toner cartridges 34 and output the received pieces of information to the transmission/reception circuit 78 of the control section 68. For example, the antennas 82*a* to 82*d* are disposed in the vicinity of the toner cartridges 34 which are attached to the image forming apparatus main body 12. More specifically, the first, second, third, and fourth antennas 82*a* to 82*d* are disposed in the vicinity of the toner cartridges 34Y, 34M, 34C, and 34B and receive pieces of information sent from the memory chips 37Y, 37M, 37C, and 37B of the toner cartridges 34Y, 34M, 34C, and 34B, respectively. In this manner, the antennas 82 serve as receiving means for receiving pieces of information relating to the toner cartridges 34 that are sent from the memory chips 37.

As described above, the toner cartridges 34Y, 34M, 34C, and 34B are equipped with the corresponding memory chips 37Y, 37M, 37C, and 37B, respectively. Each memory chip 37 includes a CPU 84, an EPROM 86, a RAM 88, a power circuit 90, a transmission/reception circuit 92, and an antenna 98. Using these components, each memory chip 37 stores information relating to the associated toner cartridge 34, issues a communication request, and sends information stored in the EPROM 86 to a transmission subject wirelessly.

In each memory chip 37, the CPU 84 controls the operations of the individual components of the memory chip 37. When receiving a radio signal, the power circuit 90 rectifies a current caused by the radio signal through electromagnetic induction and supplies, to the individual components of the memory chip 37, power that is necessary for their operations. Each memory chip 37 may be configured so as to receive power from the image forming apparatus main body 12 if it requires a voltage that is higher than a voltage generated by the power circuit 90. For example, each memory chip 37 may further be equipped with a power supply coil so as to receive power in a non-contact manner from AC power that is supplied to the image forming apparatus main body 12.

The EPROM 86 is a rewritable nonvolatile memory, for example. If a signal received from the CPU 84 indicates data writing, the EPROM 86 stores the related data. If a signal received from the CPU 84 indicates data reading, the EPROM 86 outputs stored data to the CPU 84. The EPROM 86 stores information relating to the toner cartridge 34 such as information relating to the toner. Using the EPROM 86 being a nonvolatile memory as described above makes it possible to hold data even if the image forming apparatus 10 is powered off. Since it is not necessary to provide a separate power source in the replaceable unit, cost reduction can be attained. The EPROM 86 may be any rewritable storage device capable of holding data even if the image forming apparatus 10 is powered off, such as an SRAM with power backup by a battery, an HDD (hard disk drive), or an optical memory.

The RAM 88 stores temporary information that is written or read by the CPU 84.

The transmission/reception circuit 92 modulates a signal such as data received from the CPU 84 in synchronism with a clock signal and outputs a resulting signal to the antenna 98. When receiving a radio signal, the transmission/reception circuit 92 outputs a signal such as data contained in the radio signal to the CPU 84 in synchronism with a clock signal.

The antenna 98 sends, in the form of a radio signal, a signal received from the transmission/reception circuit 92 to the antenna 82 that is disposed in the vicinity of the toner cartridge 34.

A signal to be transmitted as a radio signal may be sent out after being encrypted by the CPU 84 and converted into the radio signal.

The toner cartridges 34Y, 34M, 34C, and 34B are equipped with the presence/absence detection sensors 40Y, 40M, 40C, and 40B as the second detecting means for detecting presence/absence of the toner cartridges 34Y, 34M, 34C, and 34B, respectively. For example, each presence/absence detection sensor 40 is configured so as to detect presence/absence of the associated toner cartridge 34 by contacting or being separated from the toner cartridge 34 as the toner cartridge 34 is attached to or detached from the image forming apparatus main body 12. Each presence/absence detection sensor 40 outputs a toner cartridge detection result (e.g., "off" when the toner cartridge 34 is present and "on" (detection) when it is absent) to the CPU 70. Each presence/absence detection sensor 40 may be of any type as long as it can detect presence/absence of the toner cartridge 34, and may be a mechanical sensor, an electrical sensor, a non-contact sensor utilizing electromagnetic induction or the like, or a wireless sensor using a radio communication means.

Using the above components, the control section 68 controls access to the memory chips 37Y, 37M, 37C, and 37B on the basis of information (detection results) received from the opening/closing detection sensor 20 and the presence/absence detection sensors 40Y, 40M, 40C, and 40B. More specifically, if the opening/closing detection sensor 20 detects opening of the opening/closing cover 16, the CPU 70 performs a control so that access is made only to the memory chip 37 of a replaced toner cartridge 34 on the basis of detection results of the presence/absence detection sensors 40Y, 40M, 40C, and 40B. A memory chip access control method of the control section 68 will be described later in detail.

Although the above description is directed to the case that the wireless communication means are used as the communication means for communication between the control section 68 and the memory chips 37Y, 37M, 37C, and 37B, the communication means may be of any type as long as they enables communications between the control section 68 and the memory chips 37Y, 37M, 37C, and 37B, and may be wired (contact type) communication means using communication cables or the like.

Next, the workings of the embodiment will be described.

When an image forming operation is started, the surfaces of the photoreceptor bodies 22Y, 22M, 22C, and 22B are charged uniformly by the charging units 24Y, 24M, 24C, and 24B. Latent images are formed on the surfaces of the photoreceptor bodies 22Y, 22M, 22C, and 22B by light beams emitted from the optical writing units 26Y, 26M, 26C, and 26B. The latent images on the photoreceptor bodies 22Y, 22M, 22C, and 22B are developed by the developing units 28Y, 28M, 28C, and 28B with the developers (toners) charged (accommodated) in the toner cartridges 34Y, 34M, 34C, and 34B, whereby developer images are formed on the surfaces of the photoreceptor bodies 22Y, 22M, 22C, and 22B.

On the other hand, a sheet that has been accommodated (loaded) in the sheet supply cassette 56 of the sheet supply unit 54 is sent out and transported toward the registration rollers 62 by the feed roller 58. The sheet is stopped temporarily by the registration rollers 62 and guided toward the transport belt 46 of the transfer unit 42 with prescribed timing. Then, the developer images formed on the photoreceptor bodies 22Y, 22M, 22C, and 22B are transferred to the sheet by the transfer rollers 50Y, 50M, 50C, and 50B, whereby yellow, magenta, cyan, and black developer images are formed in superimposition on the sheet. The developer-images-formed sheet is transported to the fixing unit 52. After the developers (toners) are fused by the fixing unit 52, the sheet is ejected to the sheet ejection unit 15 by the ejection rollers 64. If a jam occurred during the print processing, the opening/closing cover 16 is opened and a jam-resolving operation is performed. When the opening/closing cover 16 is closed after the jam-resolving operation, recovery processing (described later) is started.

If print processing as described above is repeated many times, it becomes necessary to replace a replaceable unit. When it has become necessary to replace a replaceable unit, the opening/closing cover 16 is opened and a replaceable unit replacement operation is performed.

For example, if the toner in at least one toner cartridge 34 has been used up, the toner cartridge(s) 34 should be replaced. Therefore, the opening/closing cover 16 is opened and the used toner cartridge 34 is removed from the image forming apparatus main body 12. Then, a new toner cartridge 34 is attached to the image forming apparatus main body 12.

After completion of the replaceable unit replacement operation, the opening/closing cover 16 is closed, whereupon recover processing (described later) is started.

Next, a control method of the image forming apparatus 10 according to the embodiment will be described. More specifically, a memory chip access control method of the control section 68 will be described in detail with reference to FIGS. 4 to 8B.

The following description will be directed to an example that the replaceable units are the toner cartridges 34Y, 34M, 34C, and 34B and the control section 68 performs processing of reading data from a memory chip 37 as exemplary processing that includes access to a memory chip 37.

First, a description will be made of a process that is executed when a replaceable unit is replaced or another operation (e.g., a jam-resolving operation) is performed.

Figure 4:
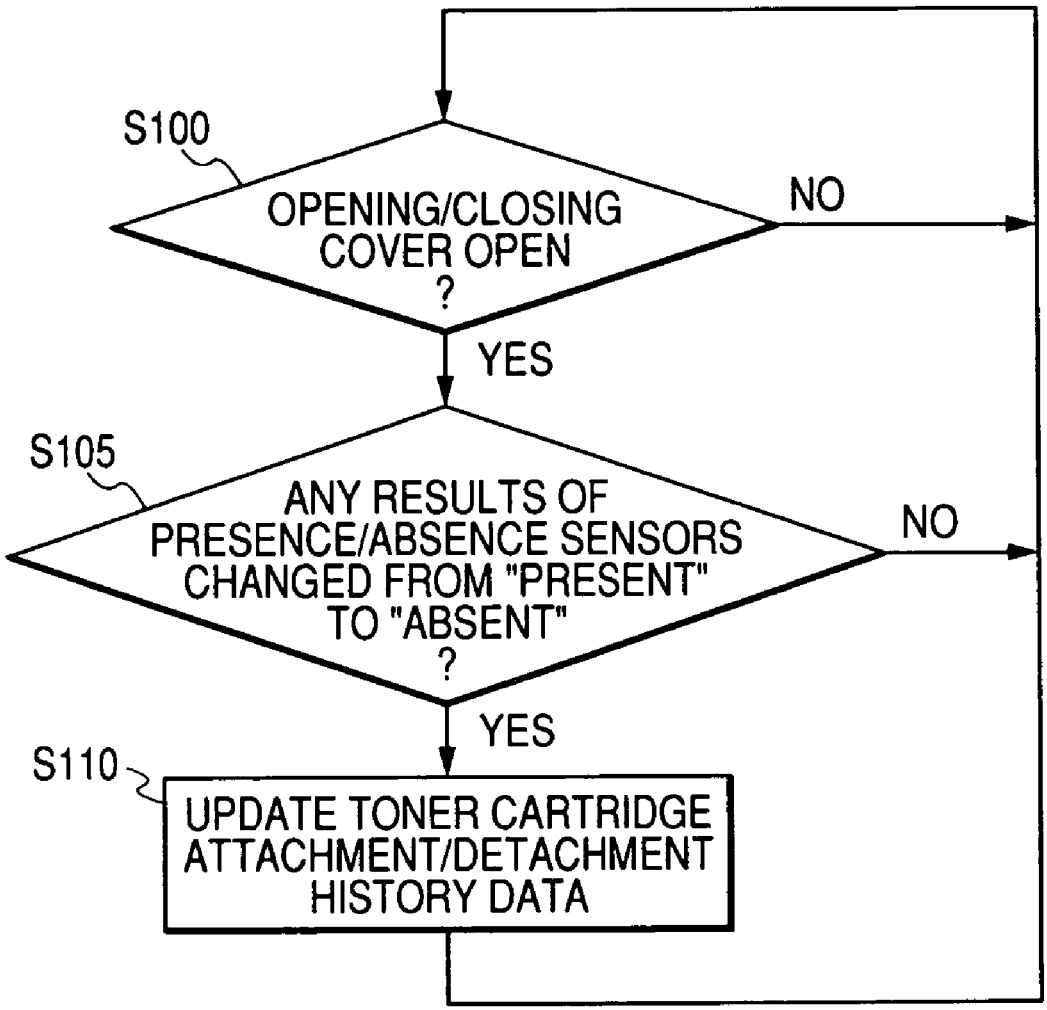
FIG. 4 is a flowchart of a replacement operation detection process in the image forming apparatus according to the embodiment of the invention.

FIG. 4 is a flowchart of a replacement operation detection process (S10) in the image forming apparatus 10 according to the embodiment, that is, a process that is executed when the opening/closing cover 16 is open.

As shown in FIG. 4, in step S100, the control section 68 judges, on the basis of a detection result of the opening/closing detection sensor 20, whether the opening/closing cover 16 is open. If the control section 68 judges that the opening/closing cover 16 is open, that is, if the detection result of the opening/closing detection sensor 20 is "on" (open), the control section 68 proceeds to step S105. If the detection result is "off" (closed), that is, if the control section 68 judges that the opening/closing cover 16 is not open, the control section 68 returns to step S100. In this manner, at a first stage of replacement of a replaceable unit, an operation necessary for replacement of at least one replaceable unit or another operation (e.g., a jam-resolving operation), that is, an operation of opening the opening/closing cover 16, is detected.

In step S105, the control section 68 judges whether the toner cartridges 34Y, 34M, 34C, and 34B have been detached. If judging that one of the detection results of the presence/absence detection sensors 40Y, 40M, 40C, and 40B has changed from "off" (present) to "on" (absent), the control section 68 proceeds to step S110. In the other cases, the control section 68 returns to step S100. In this manner, at a second stage of the replacement of a replaceable unit, an operation of replacing at least one replaceable unit is detected.

In step S110, the control section 68 updates the toner cartridge attachment/detachment history data stored in the RAM 74. More specifically, for example, 4 bits are assigned to a particular storage area of the RAM 74 for the subject replaceable units (toner cartridges 34Y, 34M, 34C, and 34B) as shown in FIG. 5A (1 bit for each subject replaceable unit). As shown in FIG. 5B, the value of each bit for which the detection result of the presence/absence sensor 40 has changed from "off" to "on" is changed to "1." Therefore, if none of the detection results of the presence/absence detection sensors 40Y, 40M, 40C, and 40B have changed from "off" to "on," that is, if none of the toner cartridges 34Y, 34M, 34C, and 34B have been detached, the toner cartridge attachment/detachment history data remains "0000." On the other hand, if all the toner cartridges 34Y, 34M, 34C, and 34B have been detached, the toner cartridge attachment/detachment history data is changed to "1111."

By repeatedly executing steps S100 to S110, the control section 68 monitors, while the opening/closing cover is open, whether the toner cartridges 34Y, 34M, 34C, and 34B have been detached. The control section 68 stores monitoring results in the RAM 74 of the control section 68 itself as toner cartridge attachment/detachment history data.

The opening/closing detection sensor 20 detects, at the first stage of replacement of a replaceable unit, an operation necessary for replacement of a replaceable unit or another operation (e.g., a jam-resolving operation), that is, an operation of opening the opening/closing cover 16. This makes it unnecessary to detect a first-stage operation, that is, an operation necessary for replacement of a replaceable unit or another operation without the need for newly providing a sensor for detecting a start of replacement of a replaceable unit or another operation, and a sensor for detecting an end thereof, etc. At the second stage of the replacement of a replaceable unit, the presence/absence detection sensors 40 detect a replaceable unit replacement operation. That is, while the opening/closing detection sensor 20 is detecting an open state (i.e., the opening/closing cover 16 is open), the presence/absence detection sensors 40 detect presence/absence of the toner cartridges 34Y, 34M, 34C, and 34B and thereby detect a replacement operation thereon.

Next, a description will be made of a process (recovery process) which is executed after the end of a replaceable unit replacement operation.

Figure 6:
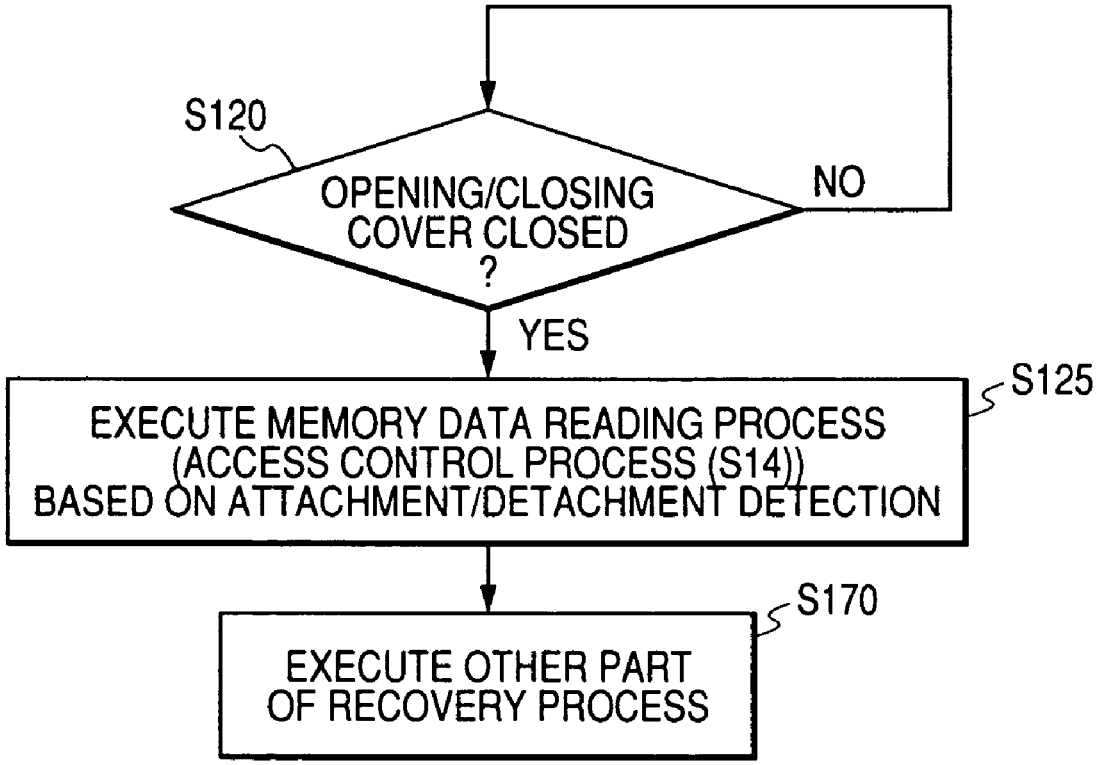
FIG. 6 is a flowchart of a recovery process in the image forming apparatus according to the embodiment of the invention.

FIG. 6 is a flowchart of a recovery process (S12) in the image forming apparatus 10 according to the embodiment, that is, a process that is executed after the opening/closing cover 16 is closed.

As shown in FIG. 6, in step S120, the control section 68 judges, on the basis of a detection result of the opening/closing detection sensor 20, whether replacement of a replaceable unit or another operation has finished, that is, whether the opening/closing cover 16 has been closed. If the control section 68 judges that the opening/closing cover 16 is open, that is, if the detection result of the opening/closing detection sensor 20 is "on" (open), the control section 68 proceeds to step S120. When it is determined that the opening/closing cover 16 is closed (the detection result is "off"), the control section 68 proceeds to step S125.

In step S125, the control section 68 executes a memory data reading process (access control process (S14); described later) that is based on attachment/detachment detection. After the end of the memory data reading process (access control process (S14)) that is based on attachment/detachment detection, the control section 68 proceeds to step S170. In step S170, the control section 68 executes the other part of the recovery process and finishes the series of steps of the recovery process (S12).

Next, the above-mentioned memory data reading process (access control process (S14)) that is based on attachment/detachment detection will be described in detail.

Figure 7:
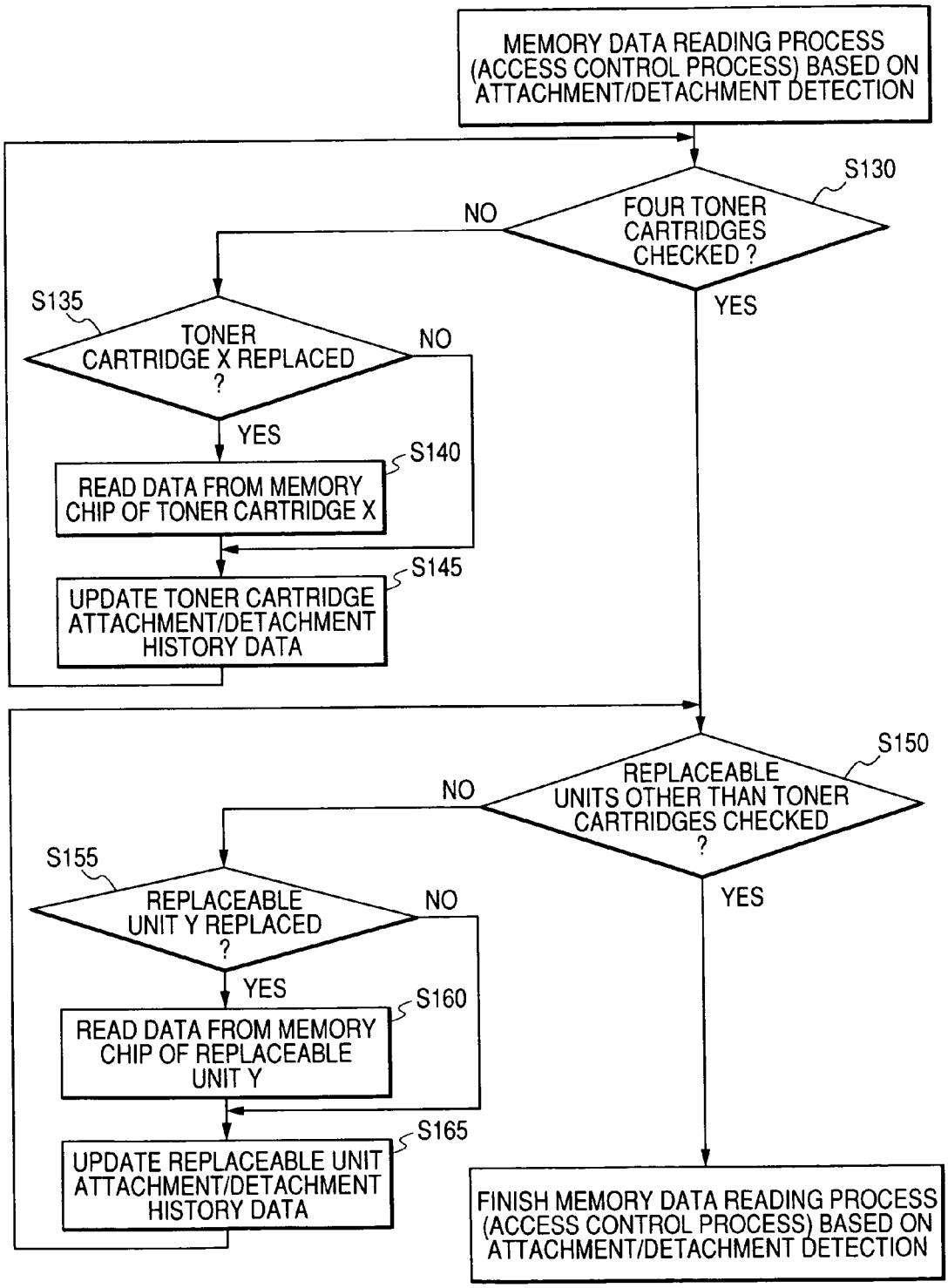
FIG. 7 is a flowchart of an access control process in the image forming apparatus according to the embodiment of the invention.

As shown in FIG. 7, when the access control process (S14) is started, in step S130 the control section 68 refers to the toner cartridge attachment/detachment data stored in the RAM 74 and judges whether a check as to whether the four toner cartridges 34Y, 34M, 34C, and 34B have been subjected to a replacement operation has been made. If judging that all of the four toner cartridges 34Y, 34M, 34C, and 34B have been checked, the control section 68 proceeds to step S150. In the other cases, the control section 68 proceeds to step S135.

In step S135, the control section 68 refers to the toner cartridge attachment/detachment history data in the RAM 74 that was updated at the above-described step S110 and judges whether a particular toner cartridge 34 has been replaced. More specifically, the control section 68 refers to the bit assigned to the toner cartridge 34Y, for example, and judges whether the toner cartridge 34Y to which this bit is assigned has been replaced. That is, the control section 68 judges whether the bit assigned to the particular toner cartridge 34 is "0" or "1." If it is "0," the control section 68 judges that the particular toner cartridge has not been replaced and proceeds to step S145. If it is "1," the control section 68 judges that the particular toner cartridge has been replaced and proceeds to step S140.

In step S140, the control section 68 reads data from the memory chip 37 of the toner cartridge 34 that was judged in step S135 to be a replaced toner cartridge. That is, the control section 68 accesses the memory chip 37 of the replaced toner cartridge 34. For example, if judging in step S135 that the bit assigned to the toner cartridge 34Y has a value "1," the control section 68 reads data relating to the toner cartridge 34Y that are stored in the memory chip 37Y of the toner cartridge 34Y.

Figures 8A, 8B:
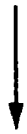
FIGS. 8A and 8B show toner cartridge attachment/detachment history data stored in the RAM of the control section according to the embodiment of the invention.

In step S145, the control section 68 updates the toner cartridge attachment/detachment history data. For example, the control section 68 refers to the toner cartridge attachment/detachment history data, changes the value of the bit that was referred to in step S135 to "0," and performs reference completion processing for the bit. More specifically, as shown in FIGS. 8A and 8B, the control section 68 changes the value of the bit assigned to the history-data-referenced toner cartridge 34Y from "1" to "0" and performs reference completion processing for the bit. After updating the toner cartridge attachment/detachment history data, the control section 68 returns to step S130.

The control section 68 executes steps S130 to S145 repeatedly a prescribed number of times and thereby refers to the first to fourth bits of the toner cartridge attachment/detachment history data in order. In doing so, if the bit referred to has a value "1," the control section 68 reads data from the memory chip 37 of a toner cartridge 34 to which the bit is assigned, changes the value of the bit to "0," and performs reference completion processing for the bit. On the other hand, if the bit referred to has a value "0," the control section 68 does not read data from the memory chip 37 and performs reference completion processing for the bit. If the control section 68 judges in step S130 that reference completion processing has been performed for all of the four bits of the toner cartridge attachment/detachment history data, that is, if the toner cartridge attachment/detachment history data has become "0000," the control section 68 finishes the series of steps and proceeds to step S150.

In step S150, the control section 68 refers to the replaceable unit attachment/detachment history data stored in the RAM 74, and judges whether a check as to whether the replaceable units other than the toner cartridges 34Y, 34M, 34C, and 34B have been subjected to a replacement operation has been made. If judging that all of the other replaceable units have been checked, the control section 68 finishes the series of steps and proceeds to step S170 (see FIG. 6). On the other hand, if judging that not all of the other replaceable units have been checked, the control section 68 proceeds to step S155.

The control section 68 executes steps S150 to S165 repeatedly a prescribed number of times in the same manner as it executed steps S130 to S145 above. That is, the control section 68 refers to the first to nth bits of the replaceable unit attachment/detachment history data in order. If the bit referred to has a value "1," the control section 68 reads data from the memory chip of a replaceable unit to which the bit is assigned, changes the value of the bit to "0," and performs reference completion processing for the bit. On the other hand, if the bit referred to has a value "0," the control section 68 does not read data from the memory chip and performs reference completion processing for the bit. If the control section 68 judges in step S150 that reference completion processing has been performed for all of the first to nth bits of the replaceable unit attachment/detachment history data, that is, if the replaceable unit attachment/detachment history data has become "000 . . . 0," the control section 68 finishes the series of steps and proceeds to step S170 (see FIG. 6).

As described above, if the opening/closing detection sensor 20 detects a first-stage operation (i.e., an operation of opening the opening/closing cover 16), the control section 68 controls access to the memory chips 37 in accordance with whether the presence/absence detection sensors 40 have detected a second-stage operation (i.e., an operation of replacing at least one toner cartridge 34). More specifically, if the opening/closing detection sensor 20 detects opening of the opening/closing cover 16, the control section 68 performs a control so that access is made only to the memory chip 37 of a replaced toner cartridge 34 on the basis of presence/absence detection results for the toner cartridges 34 produced by the presence/absence detection sensors 40. Therefore, access is not made to the memory chips 37 of unreplaced toner cartridges 34 in a recovery process, whereby the number of accesses to the memory chips 37 can be reduced. This makes it possible to shorten the recovery processing time.

Next, a first modification of the above embodiment will be described.

Figure 9:
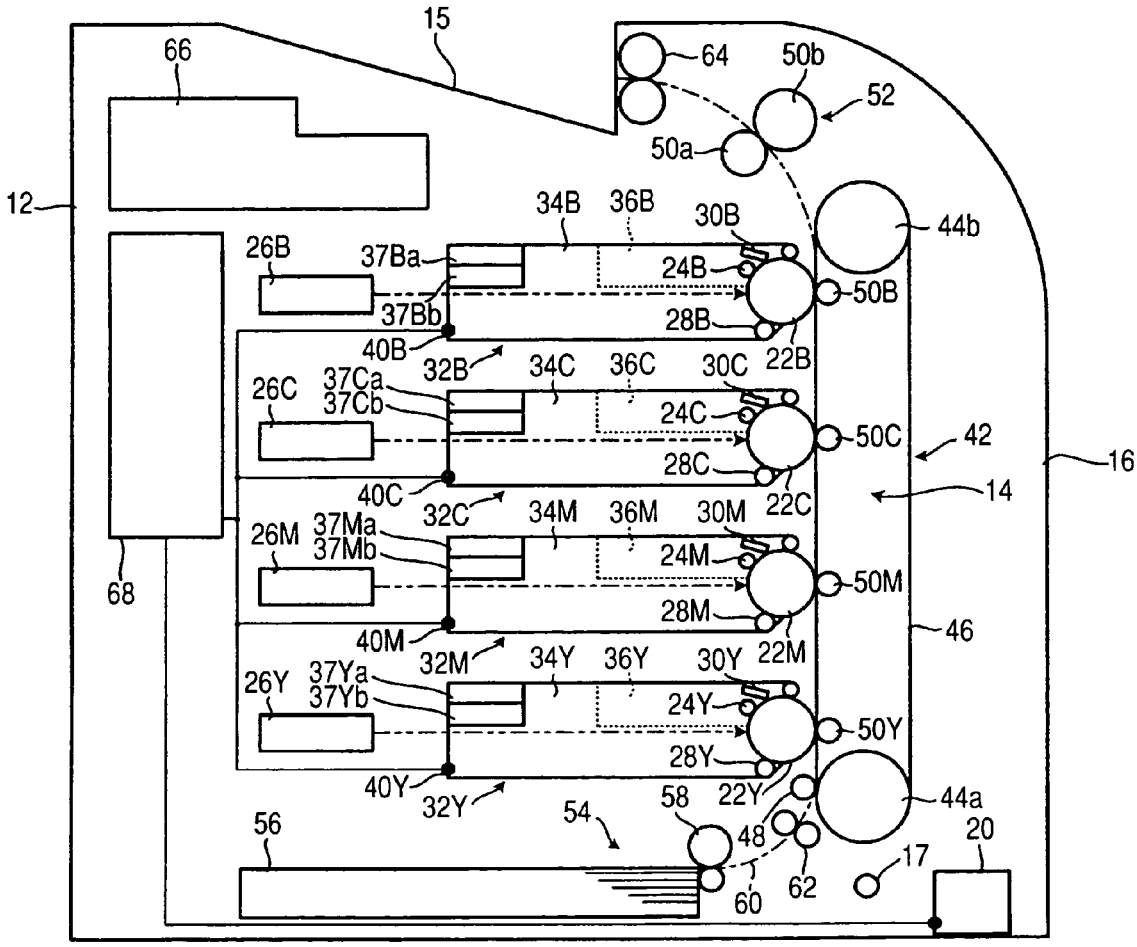
FIG. 9 is a side view of an image forming apparatus according to a first modification of the embodiment of the present invention.

FIG. 9 shows an image forming apparatus 10 according to the first modification.

As shown in FIG. 9, toner cartridges 34Y, 34M, 34C, and 34B are equipped with first memory chips 37Ya, 37Ma, 37Ca, and 37Ba and second memory chips 37Yb, 37Mb, 37Cb, and 37Bb, respectively. Information relating to toners charged (accommodated) in the toner cartridges 34Y, 34M, 34C, and 34B and other information are stored in the first memory chips 37Ya, 37Ma, 37Ca, and 37Ba. For example, data including the same information as stored in the first memory chips 37Ya, 37Ma, 37Ca, and 37Ba are stored in the second memory chips 37Yb, 37Mb, 37Cb, and 37Bb. That is, the second memory chips 37Yb, 37Mb, 37Cb, and 37Bb are provided for a backup purpose.

A control section 68 of this modification is provided so as to be able to communicate with the first memory chips 37Ya, 37Ma, 37Ca, and 37Ba and the second memory chips 37Yb, 37Mb, 37Cb, and 37Bb. Therefore, even if data in the first memory chip 37Ya, for example, are damaged, the control section 68 can acquire the same data by accessing the backup data in the second memory chip 37Yb. As such, this image forming apparatus 10 is resistant to a sudden failure.

Therefore, as in this modification, plural storage means may be provided for each replaceable unit.

Next, a second modification of the above embodiment will be described.

Figure 10:
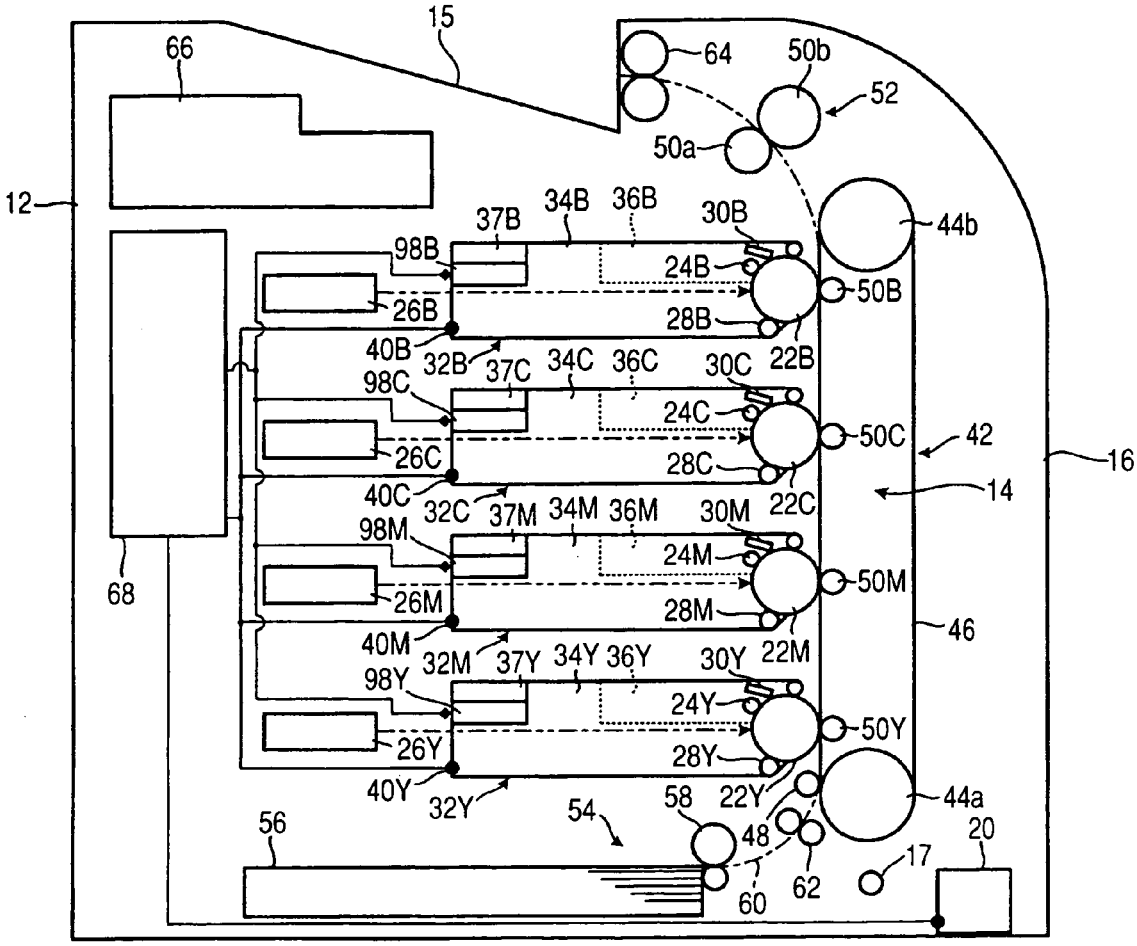
FIG. 10 is a side view of an image forming apparatus according to a second modification of the embodiment of the present invention.

FIG. 10 shows an image forming apparatus 10 according to the second modification.

As shown in FIG. 10, toner cartridges 34Y, 34M, 34C, and 34B are equipped with unit CPUs 98Y, 98M, 98C, and 98B which are connected to memory chips 37Y, 37M, 37C, and 37B, respectively. A control section 68 of this modification is provided so as to be able to communicate with the unit CPUs 98Y, 98M, 98C, and 98B.

Since the toner cartridges 34Y, 34M, 34C, and 34B are provided with the unit CPUs 98Y, 98M, 98C, and 98B in the above-described manner, the control section 68 can adapt to an improvement in the toner cartridges 34 and other changes. For example, when the toner cartridges 34 are improved (version-upgraded), there may occur a case that the control section 68 cannot access the memory chips 37 any more because an arrangement or the like of data relating to each toner cartridge 34 is changed. To avoid this problem, the unit CPUs 98 update (version-upgrade) the control section 68 so that the latter can access the memory chips 37. Since in this manner the control means is updated (version-upgraded) every time a replaceable unit is improved (version-upgraded), the stability of access to the storage means by the control means can be secured.

Therefore, as in this modification, each replaceable unit may be equipped with a control means.

Next, a third modification of the above embodiment will be described.

Figure 11:
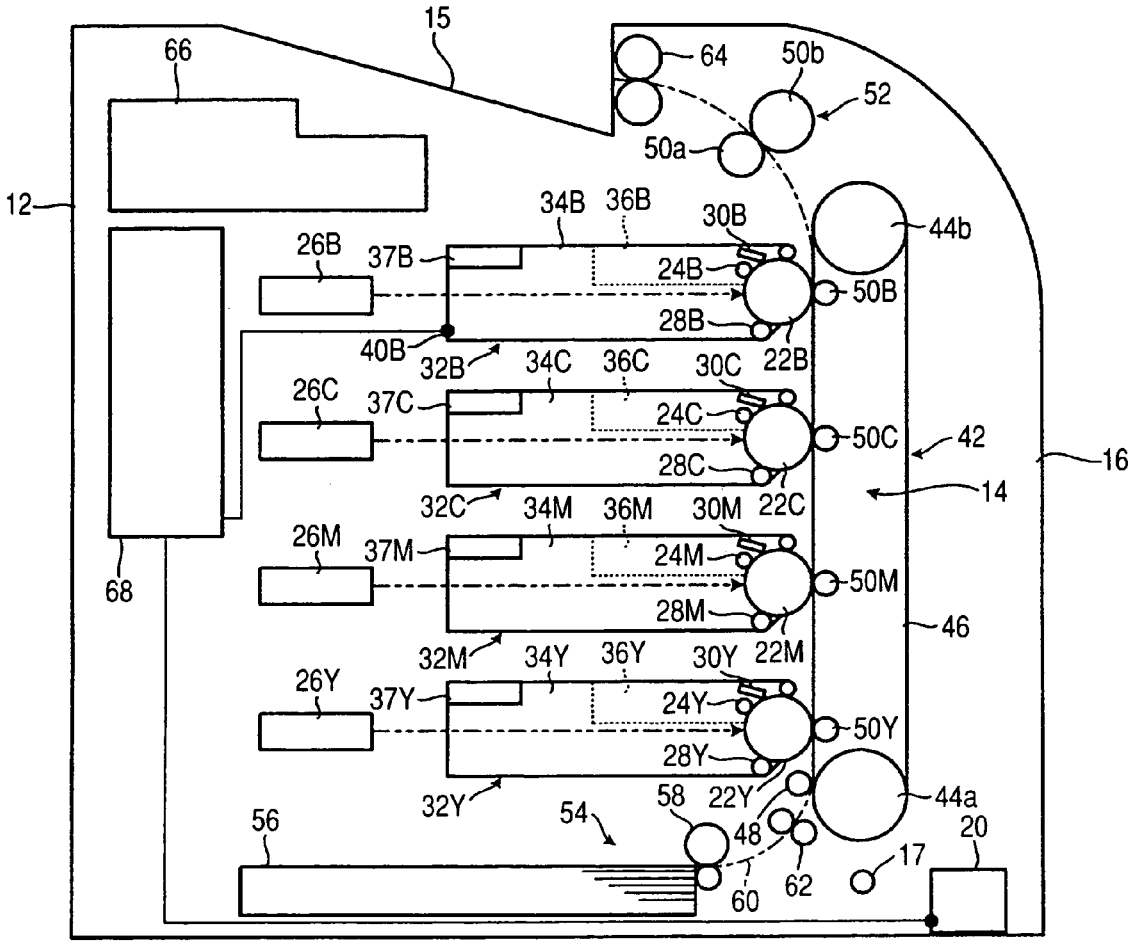
FIG. 11 is a side view of an image forming apparatus according to a third modification of the embodiment of the present invention.

FIG. 11 shows an image forming apparatus 10 according to the third modification.

As shown in FIG. 11, the toner cartridge 34B is equipped with the presence/absence detection sensor 40B for detecting presence/absence of the toner cartridge 34B. A detection result of the presence/absence detection sensor 40B (e.g., "off" when the toner cartridge 34B is present and "on" (detection) when it is absent) is output to the control section 68. That is, in this modification, the number (in this modification, one) of presence/absence detection sensors 40 is smaller than the number of toner cartridges 34Y, 34M, 34C, and 34B.

When the detection result ("on") of the opening/closing detection sensor 20 shows that the opening/closing cover 16 is open and a control section 68 of this modification judges, on the basis of a detection result of the presence/absence detection sensor 40B, that the toner cartridge 34B has been replaced, the control section 68 performs a control so that access is made to all the memory chips 37Y, 37M, 37C, and 37B.

When the opening/closing detection sensor 20 detects that the opening/closing cover 16 is open, the control section 68 performs, in response to the presence/absence detection sensor 40B's detecting a replacement operation on the toner cartridge 34B, a control so that access is made to the plural memory chips 37. With this measure, when the opening/closing cover 16 is opened and only an operation (e.g., a jam-resolving operation) other than replacement of a toner cartridge 34 is performed, access to the memory chips 37 of the toner cartridges 34 can be avoided, which can shorten the recovery processing time. Furthermore, the number of presence/absence detection sensor 40 can be made smaller than in the case where all the toner cartridges 34 are provided with the presence/absence detection sensor 40, which enables cost reduction. Reducing the number of presence/absence detection sensor 40 can accommodate a case that it is difficult to attach the presence/absence detection sensor 40 and a case that the number of ports of the CPU 70 of the control section 68 is small.

Therefore, as in this modification, the number of second detecting means may be smaller than the number of storage means.

Next, a second embodiment will be described with reference to FIGS. 12 and 13.

Figure 12:
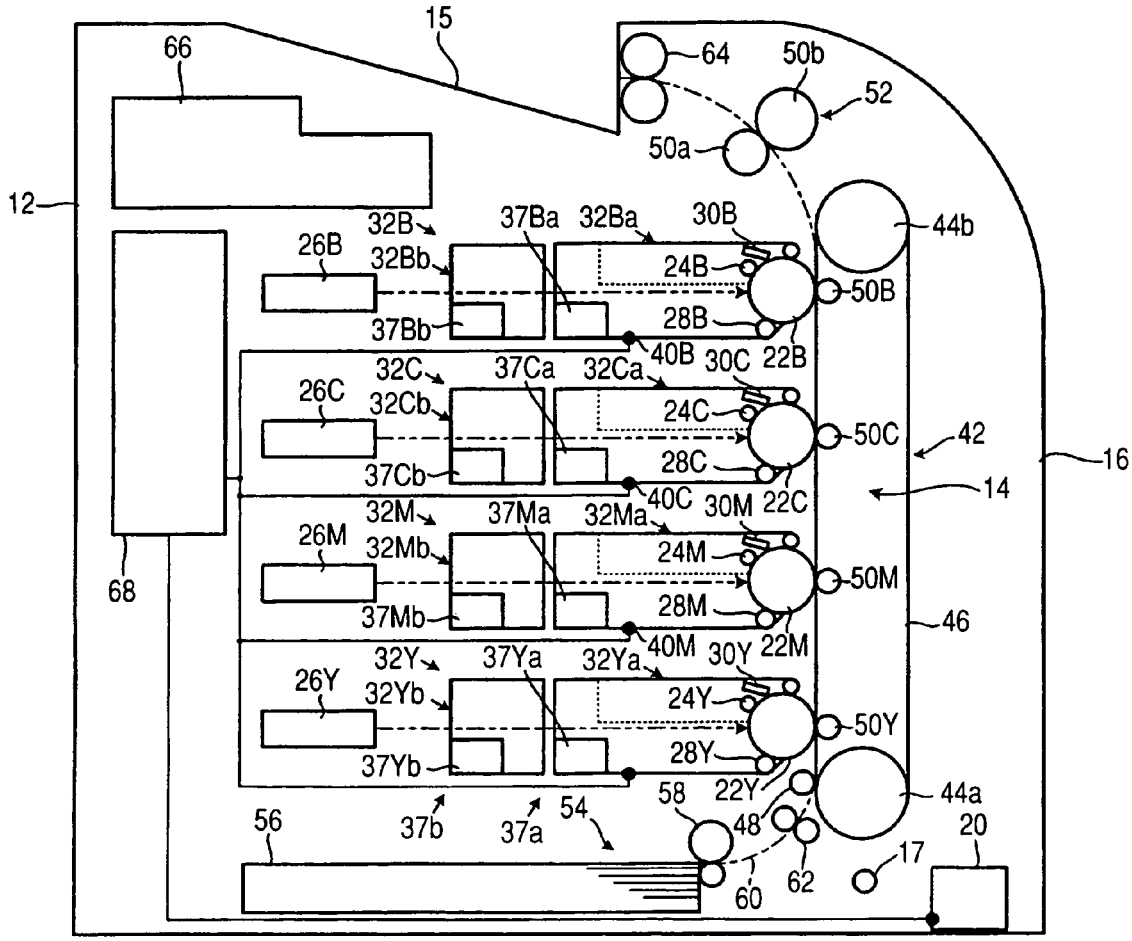
FIG. 12 is a side view of an image forming apparatus according to a second embodiment of the present invention.

FIG. 12 shows an image forming apparatus 10 according to the second embodiment.

A toner unit 32Y as a replaceable unit is composed of a toner unit main body 32Ya and a subunit 32Yb which is disposed behind (i.e., on the optical-writing-unit-26Y side of) the toner unit main body 32Ya. The subunit 32Yb that is attached to the image forming apparatus main body 12 is replaced after the toner unit main body 32Ya is removed from the image forming apparatus main body 12.

Likewise, a toner unit 32M has a toner unit main body 32Ma and a subunit 32Mb. A toner unit 32C has a toner unit main body 32Ca and a subunit 32Cb. A toner unit 32B has a toner unit main body 32Ba and a subunit 32Bb.

The toner unit main bodies 32Ya, 32Ma, 32Ca, and 32Ba are equipped with respective memory chips 37Ya, 37Ma, 37Ca, and 37Ba as storage means. The subunits 32Yb, 32Mb, 32Cb, and 32Bb are equipped with respective memory chips 37Yb, 37 Mb, 37Cb, and 37Bb.

The toner unit main bodies 32Ya, 32Ma, 32Ca, and 32Ba are equipped with presence/absence detection sensors 40Y, 40M, 40C, and 40B for detecting presence/absence of the toner unit main bodies 32Ya, 32Ma, 32Ca, and 32Ba, respectively. The presence/absence detection sensors 40Y, 40M, 40C, and 40B output detection results ("off" when the toner unit main body 32*a* is present and "on" (detection) when it is absent) to a control section 68.

Next, a description will be made of a memory data reading process (access control process) according to this embodiment that is based on attachment/detachment detection.

Figure 13:
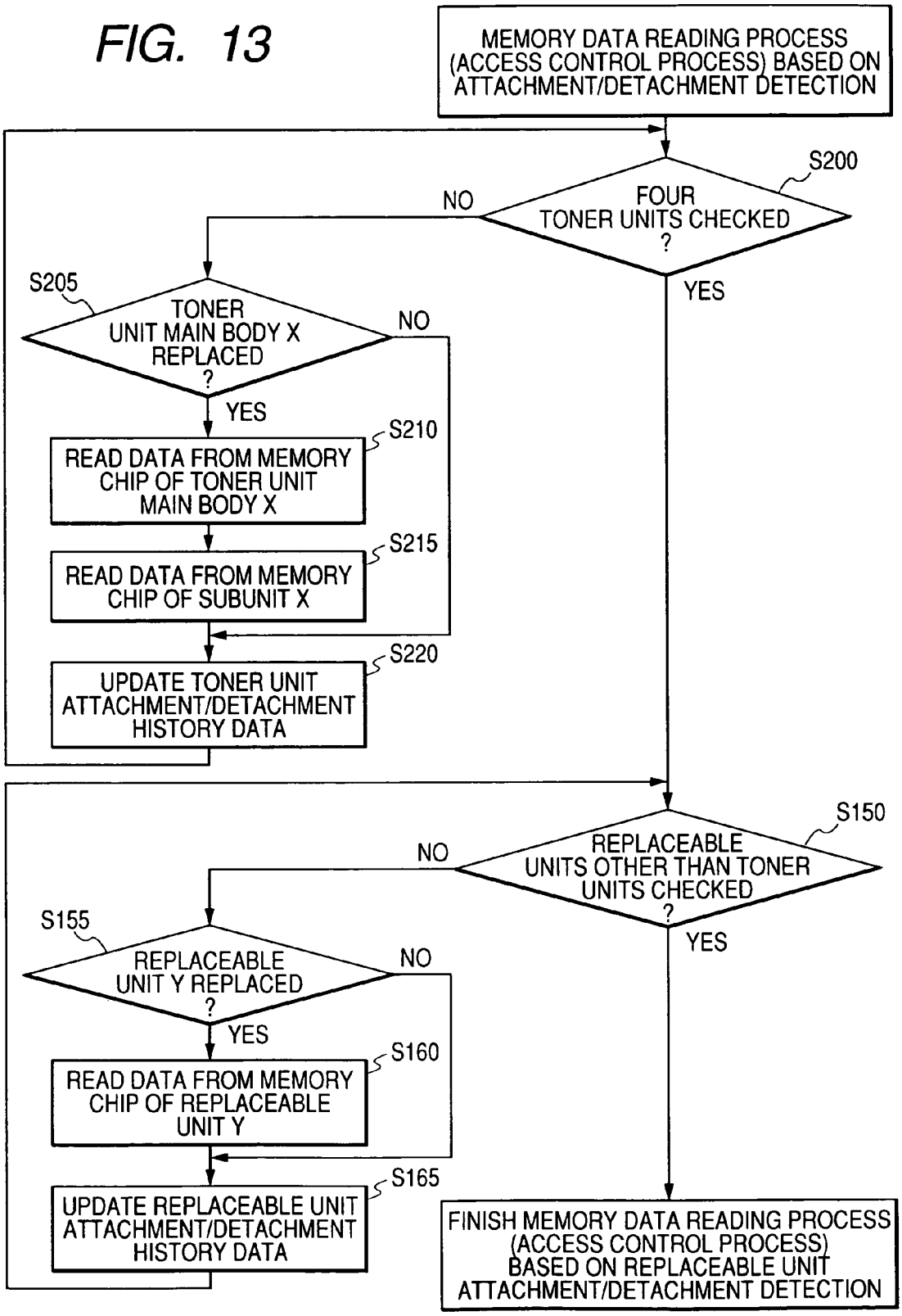
FIG. 13 is a flowchart of an access control process in the image forming apparatus according to the second embodiment of the invention.

As shown in FIG. 13, when the access control process (S16) is started, in step S200 the control section 68 refers to updated toner unit attachment/detachment history data stored in the RAM 74 and judges whether a check as to whether all of the four toner units 32Y, 32M, 32C, and 32B have been subjected to a replacement operation has been made. If judging that all of the four toner units 32Y, 32M, 32C, and 32B have been checked, the control section 68 proceeds to step S150. In the other cases, the control section 68 proceeds to step S205.

In step S205, the control section 68 refers to the updated toner unit attachment/detachment history data in the RAM 74 and judges whether a particular toner unit main body 32*a* has been replaced. If judging that the particular toner unit 32*a* has not been replaced, the control section 68 proceeds to step S220. If judging that the particular toner unit 32*a* has been replaced, the control section 68 proceeds to step S210.

In step S210, the control section 68 reads data relating to the replaced particular toner unit main body 32*a* from the memory chip 37*a* of the replaced particular toner unit main body 32*a*.

In step S215, the control section 68 reads data relating to the subunit 32*b* that is disposed behind (i.e., on the optical-writing-unit-26 side of) the replaced particular toner unit main body 32*a* from the memory chip 37*b* of the subunit 32*b*.

In step S220, the control section 68 updates the toner unit attachment/detachment history data. After updating the toner unit attachment/detachment history data, the control section 68 returns to step S200.

As described above, when the opening/closing sensor 20 detects an operation of opening the opening/closing cover 16, the control section 68 performs, in response to the presence/absence detection sensors 40's detecting a replacement operation on at least one replaceable unit (toner unit main bodies 32*a*), a control so that access is made to the plural storage means (memory chips 37*a* and 37*b*) of the plural replaced replaceable units 32*a* and 32*b*. With this measure, the number of presence/absence detection sensors 40 can be made smaller than the number of replaceable units, which makes it possible to accommodate a case that it is difficult to attach the presence/absence detection sensor 40 and a case that the number of ports of the CPU 70 of the control section 68 is small. Furthermore, when the opening/closing cover 16 is opened and only an operation (e.g., a jam-resolving operation) other than replacement of a toner unit 32 is performed, access to the memory chips 37 of the toner units 32 can be avoided, which can shorten the recovery processing time.

Therefore, as in this embodiment, the number of second detecting means may be made smaller than the number of replaceable units.

The invention is not limited to the above embodiments. For example, the invention can also be applied to image forming apparatus having a rotary developing unit.

The entire disclosure of Japanese Patent Application No. 2005-304074 filed on Oct. 19, 2005 including specifications, claims, drawings and abstracts are incorporated herein by reference in its entirety.

What is claimed is:

1. An image forming apparatus comprising:

an image forming apparatus main body;

a plurality of replaceable units attached to the image forming apparatus main body in a detachable manner;

a plurality of storage units provided in the replaceable units, the storage units storing information with respect to the replaceable units;

a first detecting unit that detects a first-stage operation for replacing the replaceable units and other operation at a first stage of replacing the replaceable units;

a second detecting unit that detects a second-stage operation for replacing the replaceable units at a second stage of replacing the replaceable units; and a control unit that controls access to the plurality of storage units to limit access to the plurality of storage units in response to the first detecting unit detecting the first-stage operation and until the second detecting unit detects the second-stage operation, wherein the control unit allows access to a plurality of storage units corresponding to the replaced replaceable units, in accordance with a detection of the second-stage operation by the second detecting unit, wherein the second detecting unit detects which of the replaceable units have been replaced.

2. The image forming apparatus according to claim 1, wherein a number of the second detecting units is smaller than a number of the replaceable units, and the control unit controls access to the storage units corresponding to the replaceable units, in accordance with the detection of the second operation by the second detecting unit, when the first detecting unit detects the first-stage operation.

3. The image forming apparatus according to claim 1, wherein the storage units include nonvolatile memories.

4. The image forming apparatus according to claim 1, wherein the image forming apparatus main body includes an opening/closing unit that replaces the replaceable units and performs the other operation, and the first detecting unit detects an opening/closing of the opening/closing unit.

5. The image forming apparatus according to claim 1, wherein the second detecting unit detects a presence/absence of at least one of the plurality of replaceable units.

* * * * *